US007287579B2

(12) United States Patent
Dilley et al.

(10) Patent No.: US 7,287,579 B2
(45) Date of Patent: Oct. 30, 2007

(54) HEAT EXCHANGER

(75) Inventors: Roland Dilley, Lomita, CA (US); Richard Paul Beldam, Torrance, CA (US); Steven M. Ayres, Redondo Beach, CA (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 11/470,202

(22) Filed: Sep. 5, 2006

(65) Prior Publication Data

US 2007/0023176 A1 Feb. 1, 2007

Related U.S. Application Data

(62) Division of application No. 10/661,174, filed on Sep. 11, 2003, now Pat. No. 7,108,054.

(51) Int. Cl.
*F28F 3/08* (2006.01)

(52) U.S. Cl. ..... 165/167; 165/158

(58) Field of Classification Search ..... 165/157, 165/158, 166, 167
See application file for complete search history.

(56) References Cited

U.S. PATENT DOCUMENTS

| | | | | |
|---|---|---|---|---|
| 6,293,337 | B1 * | 9/2001 | Strahle et al. | 165/166 |
| 6,318,456 | B1 | 11/2001 | Brenner et al. | |
| 6,920,918 | B2 * | 7/2005 | Knecht et al. | 165/157 |
| 2003/0000687 | A1 * | 1/2003 | Mathur et al. | 165/166 |
| 2003/0010480 | A1 * | 1/2003 | Shibagaki et al. | 165/158 |
| 2003/0098146 | A1 | 5/2003 | Angermann et al. | |
| 2005/0263272 | A1 * | 12/2005 | Brunner et al. | 165/158 |
| 2006/0011333 | A1 * | 1/2006 | Emrich et al. | 165/167 |

FOREIGN PATENT DOCUMENTS

| | | | |
|---|---|---|---|
| DE | 29616354 U | | 1/1997 |
| DE | 19902504 | | 8/2000 |
| DE | 10061949 | | 6/2001 |
| JP | 11303689 | | 11/1999 |
| JP | JA 11-303689 | * | 11/1999 |
| JP | 2003097890 | | 4/2003 |
| WO | WO0198723 | | 12/2001 |
| WO | WO2004017006 | | 2/2004 |
| WO | WO2004036134 | | 4/2004 |

* cited by examiner

*Primary Examiner*—Teresa J. Walberg
(74) *Attorney, Agent, or Firm*—Chris James

(57) ABSTRACT

An exemplary heat exchanger includes a heat exchanger core having a core side fluid space and a cover plate and a substantially U-shaped wall fitted at one end with an inlet header and, at an opposing end, with an outlet header, which in combination with the cover plate, define a shell side fluid space. In this example, the cover plate forms two seals with two opposing sides of the U-shaped wall, forms a seal with the inlet header and forms a seal with the outlet header. Such a heat exchange may be suitable for use as an EGR cooler. Other exemplary devices, methods and systems are disclosed.

22 Claims, 14 Drawing Sheets

HEAT EXCHANGER

RELATED APPLICATION

This application is a divisional of U.S. patent application having Ser. No. 10/661,174, filed on Sep. 11, 2003 now U.S. Pat. No. 7,108,054, which is incorporated herein by reference.

TECHNICAL FIELD

Subject matter disclosed herein relates generally to methods, devices, and/or systems for exchange of heat energy between two fluids and, in particular, a liquid and a gas wherein the gas is an exhaust gas.

BACKGROUND

Heat exchangers find a variety of uses in engine systems. For example, recent efforts to enhance fuel economy and/or reduce emissions use heat exchangers to cool exhaust gas in exhaust gas recirculation systems. Currently, exhaust gas recirculation (EGR) heat exchangers or coolers are constricted in either shell-tube or bar-plate form. Typically, the shell-tube type of construction provides less heat transfer in a given volume than does the bar-plate. However, bar-plate fabrication can be expensive. Thus, a need exists for heat exchangers that can provide heat transfer equivalent to, or better than, the bar-plate, while reducing the associated fabrication expense. Methods, devices and/or systems capable of reducing construction costs and/or facilitating and/or enhancing transfer of heat energy are described below.

BRIEF DESCRIPTION OF THE DRAWINGS

A more complete understanding of the various methods, devices and/or systems described herein, and equivalents thereof, may be had by reference to the following detailed description when taken in conjunction with the accompanying drawings wherein.

DETAILED DESCRIPTION

Figure 1:
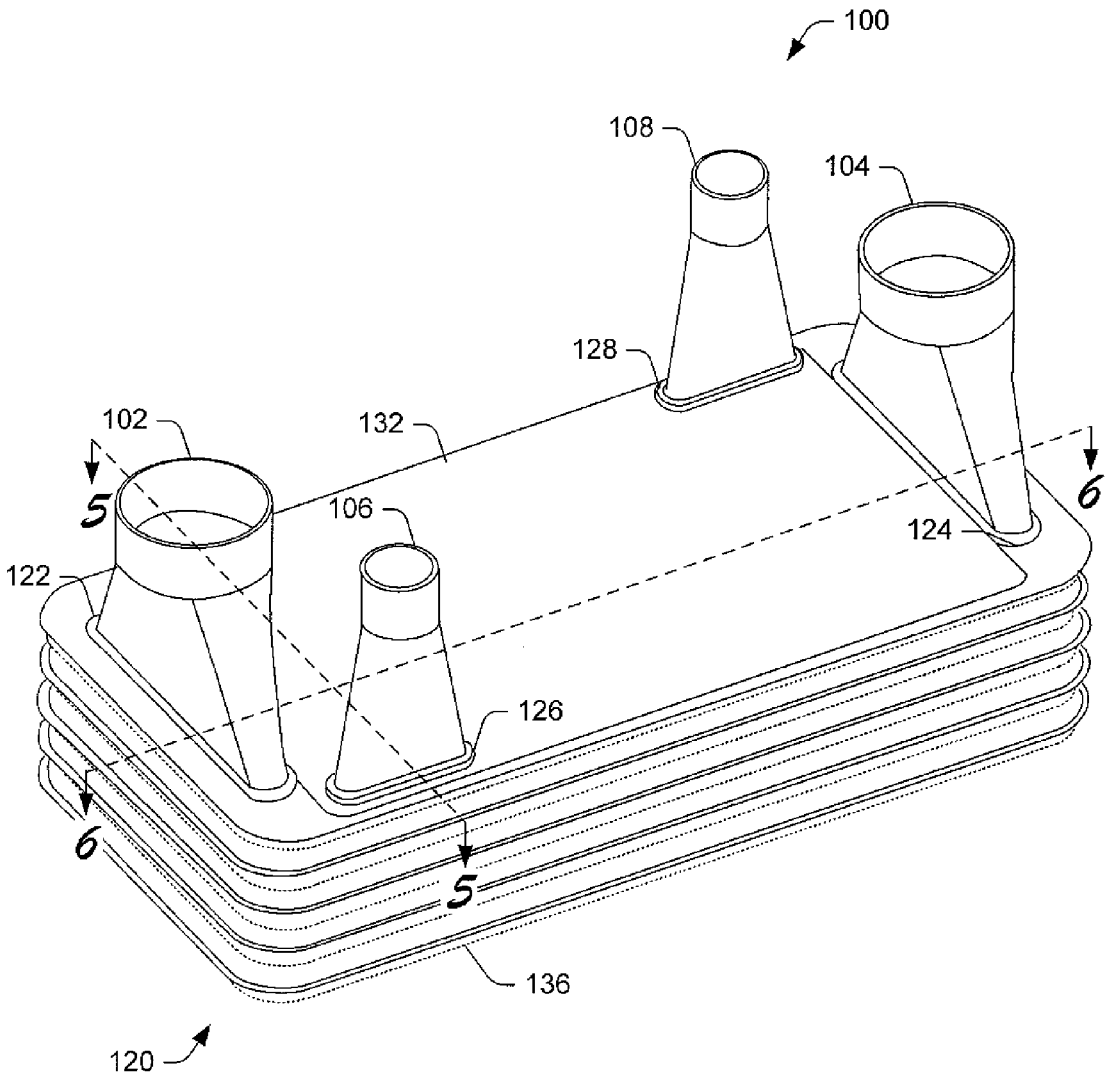
FIG. 1 is a perspective view of an exemplary heat exchange unit.

FIG. 1 shows a perspective view of an exemplary heat exchange unit 100 suitable for use as an EGR cooler. The unit 100 includes a gas inlet connector 102, a gas outlet connector 104, a liquid inlet connector 106 and a liquid outlet connector 108. The connectors 102, 104, 106, 108 direct fluid (e.g., gas and/or liquid) to and from a stack of heat exchange plates 120 that is bound by an upper cover plate 132 and a lower cover plate 136. As shown, the connectors 102, 104, 106, 108 connect to the stack 120 via the upper cover plate 132, which includes various fluid apertures. In the exemplary unit 100, the upper cover plate 132 has a gas inlet aperture 122, a gas outlet aperture 124, a liquid inlet aperture 126 and a liquid outlet aperture 128. Of course, other arrangements are possible, for example, the upper cover plate may have inlet apertures while the lower cover plate 136 may have outlet apertures.

The connectors 102, 104, 106, 108 have substantially circular flow cross-sections on an upper end and substantially rectangular flow cross-sections on a lower end. The shape of the lower end flow cross-section facilitates connection of the connectors 102, 104, 106, 108 to the fluid apertures 122, 124, 126, 128 of the upper cover plate 132. Of course, the lower end flow cross-sections and the apertures may have other shapes, such as, but not limited to, circular, elliptical, etc. In addition, to facilitate flow of gas or liquid through the stack 120 and/or to enhance heat exchange between a gas and a liquid, the cross-sectional area of the inlet and outlet apertures and/or inlet and outlet connectors may differ. For example, during heat exchange, a gas may lose heat energy and increase in density. Under such circumstances, mass flow rate of the gas will remain constant while the volumetric flow rate decreases due to the increase in density. If the cross-sectional flow area for the gas remains constant, a drop in gas velocity normal to the cross-sectional flow area will occur. Thus, in an effort to maintain gas velocity, a gas outlet connector may have a cross-sectional flow area that is smaller than that of a gas inlet connector. Further, an outlet aperture may have a cross-sectional area that is less than that of an inlet aperture. Yet further, or alternatively, a stack may have a cross-sectional flow area that decreases with respect to the flow path of a gas. An exemplary stack having such characteristics is described below with respect to FIG. 6.

In general, the exemplary heat exchange unit 100 is constructed from a heat-resistant material, such as, but not limited to, stainless steel. For example, an exemplary heat exchanger is constructed from materials capable of withstanding temperatures greater than approximately 1000 F. (e.g., approximately 538 C.). Hence, an exemplary stack plate or cover plate may be constructed from stainless steel having a thickness of approximately 0.012 inch (e.g., approximately 0.3 mm). Further, the stack of heat exchange plates 120 and/or the upper cover plate 132 and/or the lower cover plate 136 (e.g., or a bottom plate) may be subjected to a brazing process that forms appropriate seals between various plates and/or flow partitions, if present. Of course, additional or alternative processes (e.g., welding, chemical adhesion, chemical bonding, etc.) may be used to form or help form seals. Plates may optionally include compression or press-fit seals. Flow partitions may provide a stack and/or cover plates with some additional structural integrity for withstanding brazing and/or fluid flow pressures. An exemplary flow partition, as described in more detail below, may be constructed from stainless steel having a thickness of approximately 0.004 inch (e.g., approximately 0.1 mm) to approximately 0.006 inch (e.g., approximately 0.15 mm).

Figure 2:
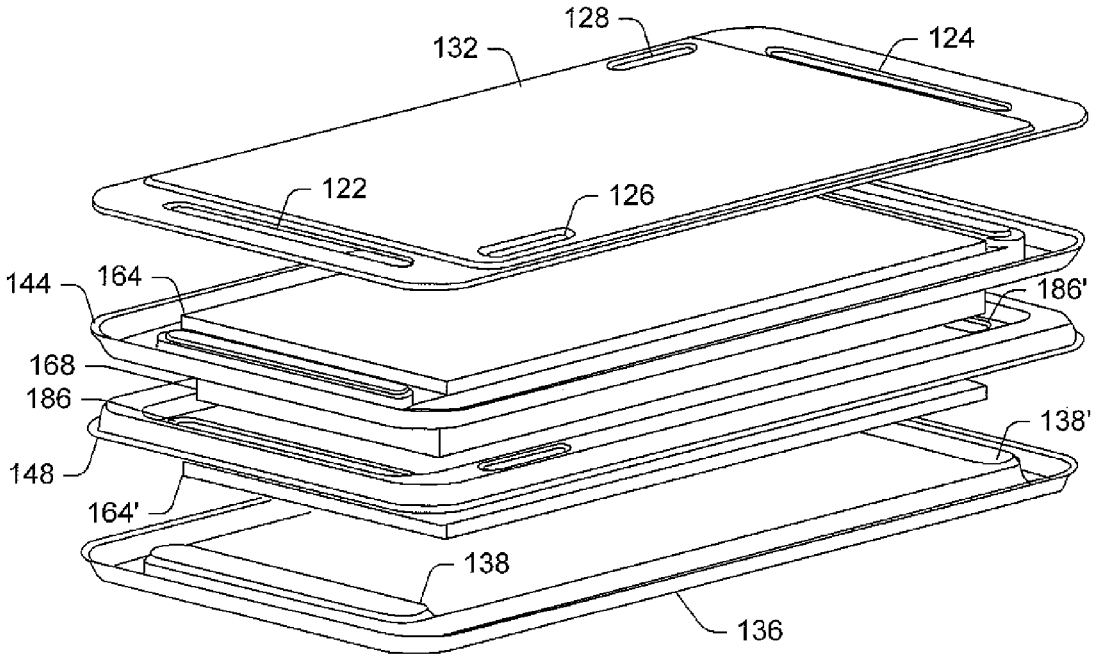
FIG. 2 is a perspective view of an exploded stack of heat exchange and cover plates of an exemplary heat exchange unit.

FIG. 2 shows an exploded perspective view of stack plates and cover plates 132, 136, 144, 148 of an exemplary heat exchange unit. An upper cover plate 132 and a lower cover plate 136 bound a stack of two plates 144, 148 and three flow partitions 164, 168, 164'. The upper plate 144 connects to the upper cover plate 132 and holds an upper liquid flow partition 164 in a space defined by the upper cover plate 132 and the upper plate 144. The lower plate 148 connects to the lower cover plate 136 and holds a lower liquid flow partition 164' in a space defined by the lower cover plate 136 and the lower plate 148. The upper plate 144 and the lower plate 148 also connect and hold a gas flow partition 168 in a space defined by the upper plate 144 and the lower plate 148.

As shown, the upper cover plate 132 includes a gas inlet aperture 122 and a gas outlet aperture 124 while the lower cover plate 136 includes plug regions 138, 138', which plug gas flow apertures 186, 186' of the lower plate 148. Of course, a lower plate optionally omits gas flow apertures which may alleviate the need for a lower cover plate having such plug regions.

According to this arrangement, gas can enter the stack and flow through flow paths defined at least in part by the gas flow partition 168 and then exit the stack while liquid can enter the stack and flow through flow paths defined at least in part by the liquid flow partitions 164, 164' and then exit the stack. In general, this arrangement is suitable to facilitate transfer of heat energy from a gas to a cooler liquid. For example, gas in the paths defined by the gas flow partition 168 may transfer heat energy to liquid in paths defined by the upper liquid flow partition 164 and/or the lower liquid flow partition 164'. For most applications, a two plate stack having an upper cover plate and a lower cover plate represents a minimum number of stack plates and/or cover plates to achieve acceptable, but perhaps not optimal, heat transfer.

Figure 3:
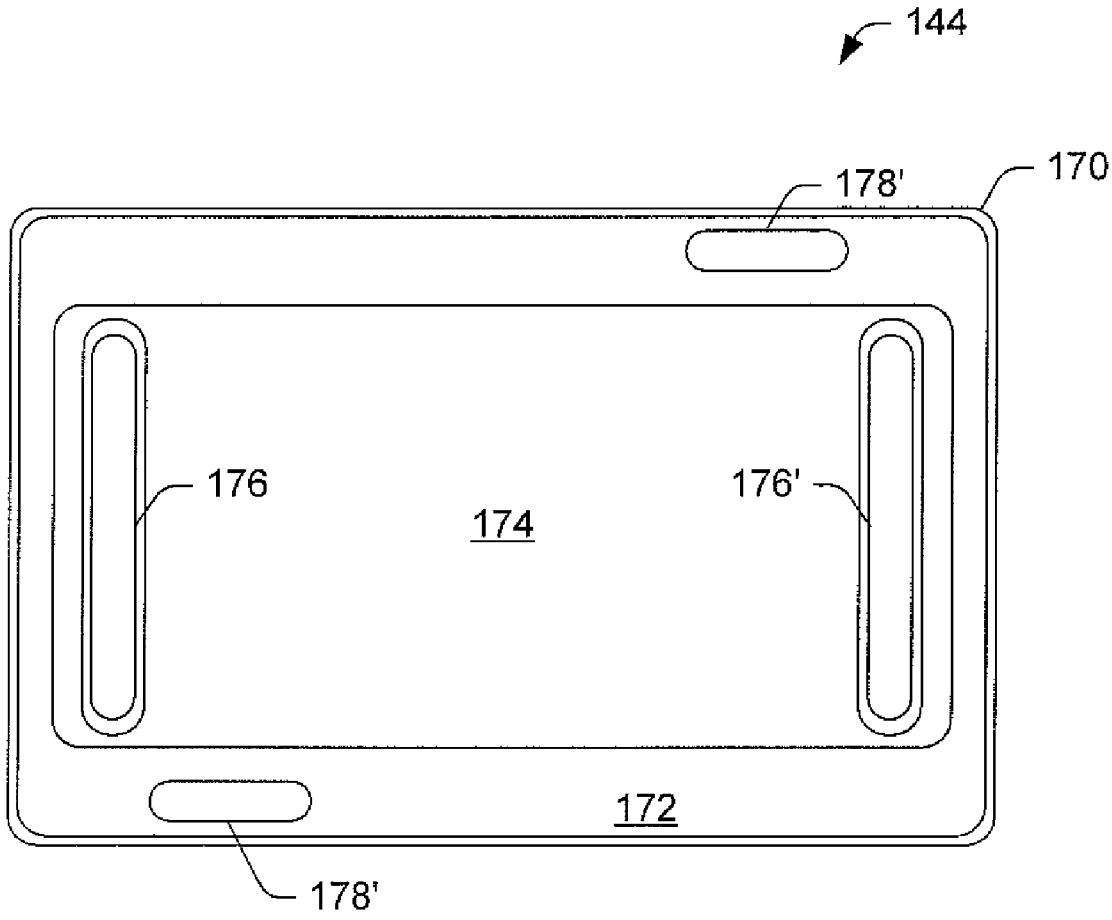
FIG. 3 is a top view of an exemplary heat exchange plate.

FIG. 3 shows a top view of the exemplary upper plate 144. The exemplary upper plate 144 has a raised outer edge 170, a lower inner surface 172 and an upper inner surface 174, being higher than the lower inner surface 172. The upper inner surface 174 includes raised gas flow apertures 176, 176' while the lower inner surface 172 includes liquid flow apertures 178, 178'. Any of the surfaces (including opposite surfaces which are not shown) may include surface indicia to increase surface area and/or to increase turbulence of a gas or liquid at or near a surface.

The upper inner surface 174 is suitable for holding a liquid flow partition such as the liquid flow partition 164 of FIG. 2. Further, such a flow partition is optionally integral with the upper inner surface 174. For example, the upper inner surface 174 optionally includes raised partitions that may help to define flow paths and direct flow of a liquid. An exemplary flow partition may include a plurality of vertical partitions that form channel shaped paths.

If the upper plate 144 is connected to the bottom side of an upper cover plate (e.g., the cover plate 132), the raised gas flow apertures 176, 176' connect to gas flow apertures (e.g., the apertures 122, 124) of the upper cover plate and/or connectors attached thereto in a manner that does not permit gas to flow into the space between and defined by the upper cover plate (e.g., the cover plate 132) and the upper plate 144, which is a liquid flow space. Similarly, if the upper plate 144 is connected to the bottom side of a lower plate (e.g., plate 148), the raised gas flow apertures 176, 176' connect to the lower plate in a manner that does not permit gas to flow into the space between and defined by the lower plate and the upper plate (e.g., plate 144), which is a liquid flow space.

An exemplary upper plate has the following dimensions: approximately 7.6 cm (e.g., approx. 3 in.) in a widthwise dimension; approximately 15.2 cm (e.g., approx. 6 in.) in a lengthwise dimension; and approximately 0.25 cm (e.g., approx. 0.1 in.) in thickness.

Figure 4:
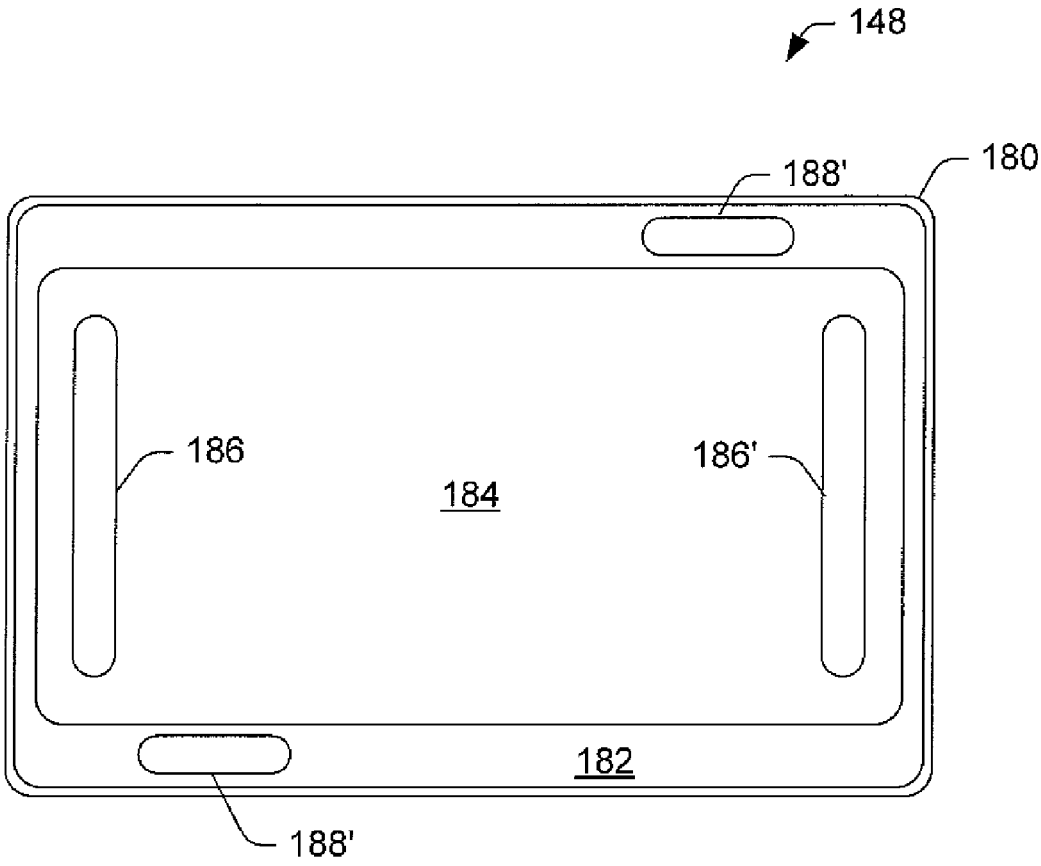
FIG. 4 is a top view of an exemplary heat exchange plate.

FIG. 4 shows a top view of the exemplary lower plate 148. The exemplary lower plate 148 has an outer edge 180, an upper inner surface 182 and a lower inner surface 184, being lower than the upper inner surface 182. The lower inner surface 184 includes gas flow apertures 186, 186' while the upper inner surface 182 includes liquid flow apertures 188, 188'. Any of the surfaces (including opposite surfaces which are not shown) may include surface indicia to increase surface area and/or to increase turbulence of a gas or liquid at or near a surface.

The lower inner surface 184 is suitable for holding a gas flow partition such as the gas flow partition 168 of FIG. 2. Further, such a flow partition is optionally integral with the lower inner surface 184. For example, the lower inner surface 184 optionally includes raised partitions that may help to define flow paths and direct flow of a gas. An exemplary flow partition may include a plurality of vertical partitions that form channel shaped paths.

If the lower plate 148 is connected to the upper side of an upper plate (e.g., the plate 144), the gas flow apertures 186, 186' connect with the raised gas flow apertures 176, 176' in a manner that does not permit gas to flow into the space between and defined by the lower plate 148 and the upper side of the upper plate (e.g., the plate 144), which is a liquid flow space. Similarly, if the lower plate 148 is connected to the bottom side of an upper plate (e.g., plate 144), the raised liquid flow apertures 188, 188' connect with the liquid flow apertures 178, 178' of the upper plate in a manner that does not permit liquid to flow into the space between and defined by the lower plate and the bottom side of the upper plate (e.g., plate 144), which is a gas flow space. Further, if the lower plate 148 is connected to the upper side of a lower cover plate (e.g., the cover plate 136), then the gas flow apertures 186, 186' are plugged by the raised plug regions (e.g., regions 138, 138') of the lower cover plate (e.g., the cover plate 136), which prevents gas from entering the space between and defined by the lower plate 148 and the upper side of the lower cover plate (e.g., the cover plate 136), which is a liquid flow space.

Overall, each upper plate 148 has a lower inner surface 184 that helps to define a gas flow space wherein the opposing surface (not shown in FIG. 4) helps to define a liquid flow space. Similarly, each lower plate 144 has an upper inner surface 174 that helps to define a liquid flow space wherein the opposing surface (not shown in FIG. 3) helps to define a gas flow space. In general, the lower surface of an upper cover plate (e.g., the upper cover plate 132) helps to define a liquid flow space whereas, the upper surface of the lower cover plate (e.g., the lower cover plate 136) helps to define a liquid flow space.

An exemplary lower plate has the following dimensions: approximately 7.6 cm (e.g., approx. 3 in.) in a widthwise dimension; approximately 15.2 cm (e.g., approx. 6 in.) in a lengthwise dimension; and approximately 0.25 cm (e.g., approx. 0.1 in.) in thickness.

Figure 5:
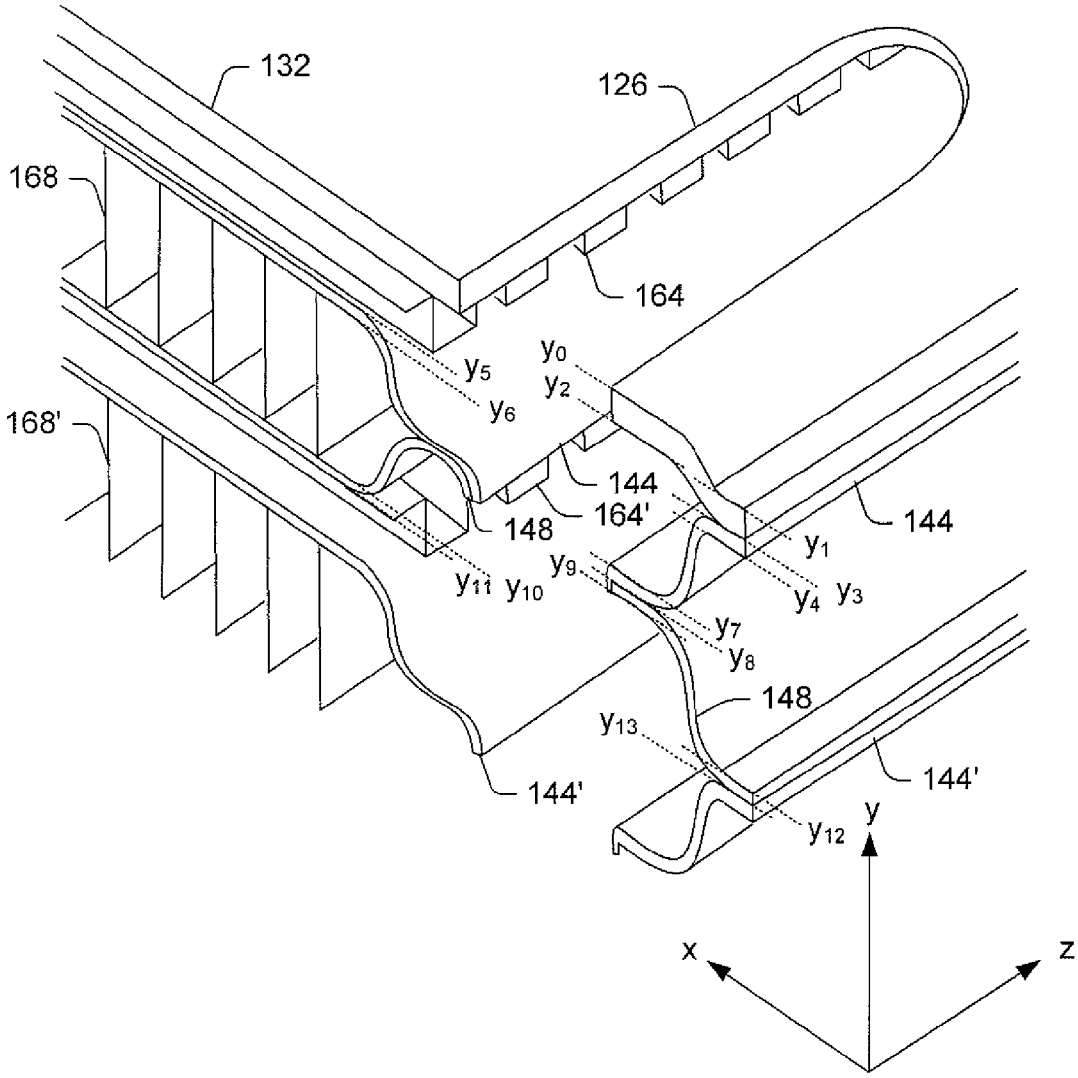
FIG. 5 is a perspective view of a cutaway of an exemplary stack of heat exchange plates having a cover plate.

FIG. 5 shows a cutaway perspective view of the exemplary unit 100 of FIG. 1 and a corresponding x, y, z coordinate system. The cut passes substantially orthogonally to the xz-plane through the liquid aperture 126 of the upper cover plate 132. The upper cover plate 132 has an upper surface at $y_0$ with a corresponding opposing surface at $y_2$, which descend to an outer edge having an upper surface at $y_1$ and a corresponding opposing surface at $y_3$. An upper plate 144 is positioned below the upper cover plate 132 and the two plates meet along the outer edge of the upper cover plate 132 at the surface at $y_3$. The upper plate 144 has a thickness equal to approximately the difference between $y_3$ and $y_4$, $y_5$ and $y_6$, or $y_7$ and $y_8$. The upper surface at $y_5$ of the upper plate 144 and the lower surface at $y_2$ of the upper cover plate 132 define a liquid flow space which has a liquid flow partition 164 positioned therein. The height of the liquid flow space is approximately equal to the difference between $y_2$ and $y_5$. The liquid flow partition 164 includes a plurality of vertical partitions that define a plurality of flow paths (e.g., channels, etc.). In general, the vertical partitions are in contact with the upper and lower surfaces that define the liquid flow space (e.g., the surfaces at $y_2$ and $y_5$). Liquid entering the unit 100 via the liquid aperture 126 of the upper cover plate 132 may enter the plurality of flow paths and eventually exit the unit 100. Further, a liquid flow partition may act to increase surface area for transfer of heat energy. Yet further, the aforementioned vertical partitions may include surface indicia to increase surface area and/or to increase turbulence at or near a vertical partition. In general, an increase in turbulence of a flowing liquid at or near a wall (e.g., a vertical partition, a horizontal surface, or other surface) will enhance transfer of heat energy to the liquid.

A lower plate 148 is positioned below the upper plate 144. The two plates meet at a liquid flow aperture at approximately $y_8$. The lower plate 148 has a thickness equal approximately to the difference between $y_8$ and $y_9$, $y_{10}$ and $y_{11}$, and $y_{12}$ and $y_{13}$. The upper plate 144 optionally includes a lip having a height equal to approximately the difference between $y_8$ and $y_9$. The lip may help to seal the upper plate 144 and the lower plate 148 about the liquid flow aperture.

The lower surface at $y_6$ of the upper plate 144 and the upper surface at $y_{10}$ of the lower plate 148 define a gas flow space which has a gas flow partition 168 positioned therein. The height of the gas flow space is approximately equal to the difference between $y_6$ and $y_{10}$. The gas flow partition 168 includes a plurality of vertical partitions that define a plurality of flow paths (e.g., channels, etc.). In general, the vertical partitions are in contact with the upper and lower surfaces that define the gas flow space (e.g., the surfaces at $y_6$ and $y_{10}$). In this example, the vertical partitions of the gas flow partition 168 are substantially orthogonal to the vertical partitions of the liquid flow partition 164. Gas entering the unit 100 via a gas aperture of the upper cover plate 132 may enter the plurality of flow paths and eventually exit the unit 100. In particular, gas entering the unit 100 may flow through such flow paths and transfer heat energy to a cooler liquid. Further, a gas flow partition may act to increase surface area for transfer of heat energy. Yet further, the aforementioned vertical partitions may include surface indicia to increase surface area and/or to increase turbulence at or near a vertical partition.

FIG. 5 also includes another upper plate 144' which is positioned below the lower plate 148. This particular upper plate 144' meets the lower plate 148 at $y_{13}$ to form an outer seal, similar to the outer seal at $y_3$ formed between the upper cover plate 132 and the upper plate 144. Further, an additional liquid flow partition 164' is shown positioned below the plate 148 and an additional gas flow partition 168' is shown positioned below the second upper plate 144'. Of course, additional plates and/or partitions may follow.

An exemplary upper cover plate may have the following dimensions with $y_3$ arbitrarily defined at y=0 mm (e.g., $y_3$=0 mm): $y_2$=1.3 mm; $y_1$=2.3 mm; and $y_0$=3.6 mm. Of course, in another example, $y_2$ may exceed $y_1$, which may act to increase a height or space between adjacent plates. An exemplary upper plate may have the following dimensions with $y_9$ arbitrarily defined at y=0 mm (e.g., $y_9$=0 mm): $y_8$=0.3 mm; $y_7$=0.6 mm; $y_6$=3.5 mm; $y_5$=3.8 mm; $y_4$=4.8 mm; and $y_3$=5.1 mm. An exemplary lower plate may have the following dimensions with $y_{13}$ arbitrarily defined at y=0 mm (e.g., $y_{13}$=0 mm): $y_{12}$=0.3 mm; $y_{11}$=2.6 mm; $y_{10}$=2.9 mm; $y_9$=5.8 mm; and $y_8$=6.1 mm. Given these exemplary dimensions, a liquid space has a height of approximately 2.6 mm and a gas space has a height of approximately 6.4 mm.

The exemplary dimensions allow for an estimation of flow conditions. For example, a liquid flow space may be considered to have a cross-sectional flow area of approximately 0.26 cm by approximately 15.2 cm or approximately 4 $cm^2$, with a corresponding hydraulic diameter of approximately 0.5 cm. Given a single liquid flow space, a liquid flow rate of approximately 160 $cm^3.^{-1}$ (e.g., about 2.5 gallons per minute) and an area of approximately 4 $cm^2$, an average flow velocity along an x-axis of approximately 40 $cm.s^{-1}$ results. Assuming a liquid density of approximately 1 $g.cm^{-3}$ and a viscosity of 0.01 $g.cm^{-1}.s^{-1}$, a Reynolds number (i.e., density times hydraulic diameter times velocity divided by viscosity) of approximately 2000 results, which is typically indicative of turbulent flow. Of course, various flow dividers, surface indicia, etc., may also be used to promote turbulent flow and thereby increase heat transfer. In general, turbulence is associated with a decrease in boundary layer thickness, which, in turn, is associated typically with an increase in heat transfer. Of course, similar calculations or estimates may be used for multiple plates that create multiple liquid flow spaces. For example, an exemplary heat exchanger having four liquid flow spaces, each having a height of approximately 0.26 cm and a length of approximately 15.2 cm, would have an average Reynolds number of 2000 for a liquid flow rate of about 10 gallons per minute (e.g., approx. 640 $cm^3.s^{-1}$).

As described herein, an exemplary heat exchanger has a cross-sectional area and a number of layered liquid flow spaces selected to maintain a Reynolds number (e.g., typically greater than or equal to approx. 2000) tending toward turbulent flow at a given liquid flow rate. An exemplary heat exchanger optionally operates in a liquid flow rate range from approximately 120 $cm^3.s^{-1}$ (e.g., approx. 2 gallons per minute) to approximately 6500 $cm^3.s^{-1}$ (e.g., approx. 100 gallons per minute), wherein an average Reynolds number of greater than 2000 exists for flow rates greater than approximately 640 $cm^3 .s^{-1}$ (e.g., approximately 10 gallons per minute).

With respect to gas flow rate, in one example, gas flow rate is given or provided in units of mass or weight per unit time in a range of approximately 15 $g.s^{-1}$ (e.g., approximately 2 lb per minute) to approximately 150 $g.s^{-1}$ (e.g., approximately 20 lb per minute). Of course, other gas flow rates may be used if desired and optionally depend on heat transfer requirements. In addition, various calculations related to gas flow are possible (e.g., Reynolds number, flow per gas space, number of spaces, etc.), which may be compared to conditions and/or requirements for liquid flow rates. Such calculations may help in determining number of spaces and/or various dimensions, etc. While various examples refer to gas and liquid flow spaces, depending on circumstances, such spaces may include more than one phase (e.g., gas, liquid and/or particulate phases) or a liquid space may serve as a gas space and/or a gas space may serve as a liquid space.

Figure 6:
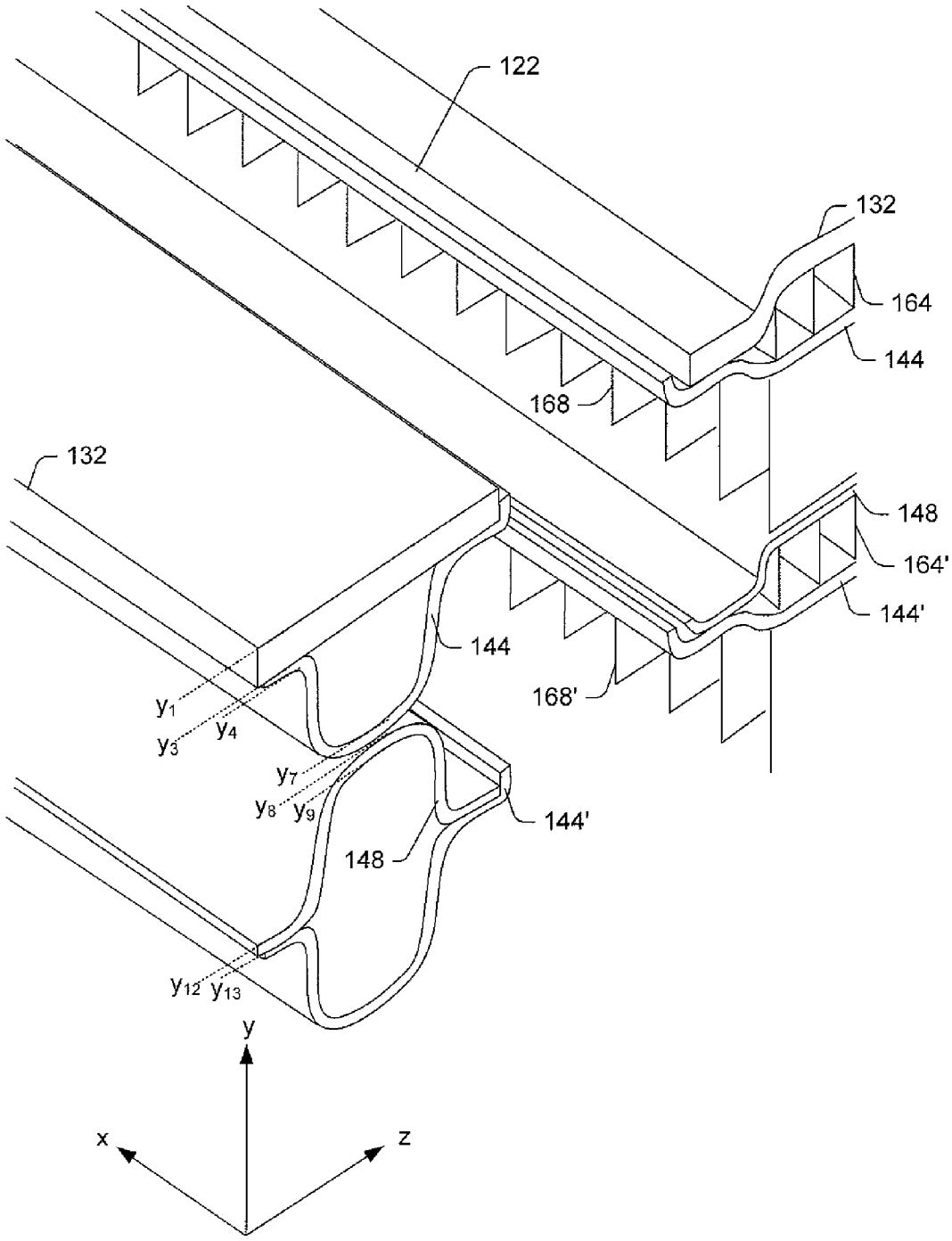
FIG. 6 is a perspective view of a cutaway of an exemplary stack of heat exchange plates having a cover plate.

FIG. 6 shows a cutaway perspective view of the exemplary unit 100 of FIG. 1. The cut passes substantially orthogonally through the gas aperture 122 of the upper cover plate 132. Various positions along the y-axis are also shown and correspond to those shown in FIG. 5. An upper plate 144 is positioned below the upper cover plate 132. The two plates meet to form an outer seal at an outer edge and an inner seal at an inner edge about a gas aperture, both positioned at approximately $y_3$. The upper plate 144 optionally has an upturned lip that helps to form the inner seal and/or inner edge about the gas aperture. The height of the lip is optionally equal to the height of the lip about the liquid aperture discussed with reference to FIG. 5.

The upper surface of the upper plate 144 and the lower surface of the upper cover plate 132 define a liquid flow space which has a liquid flow partition 164 positioned therein. The liquid flow partition 164 includes a plurality of vertical partitions that define a plurality of flow paths (e.g., channels, etc.). Liquid entering the unit 100 via a liquid aperture of the upper cover plate 132 may enter the plurality of flow paths and eventually exit the unit 100. Further, a liquid flow partition may act to increase surface area for transfer of heat energy. Yet further, the aforementioned vertical partitions may include surface indicia to increase surface area and/or to increase turbulence at or near a vertical partition. In general, an increase in turbulence of a flowing liquid at or near a wall (e.g., a vertical partition, a horizontal surface, or other surface) will enhance transfer of heat energy to the liquid.

A lower plate 148 is positioned below the upper plate 144. These two plates meet to form an outer seal at $y_8$ and about liquid flow apertures as discussed above with reference to FIG. 5. The lower surface of the upper plate 144 and the upper surface of the lower plate 148 define a gas flow space which has a gas flow partition 168 positioned therein. The gas flow partition 168 includes a plurality of vertical partitions that define a plurality of flow paths (e.g., channels, etc.). In this example, the vertical partitions of the gas flow partition 168 are substantially orthogonal to the vertical partitions of the liquid flow partition 164. Gas entering the unit 100 via the gas aperture 122 of the upper cover plate 132 may enter the plurality of flow paths and eventually exit the unit 100. In particular, gas entering the unit 100 may flow through such flow paths and transfer heat energy to a cooler liquid. Further, a gas flow partition may act to increase surface area for transfer of heat energy. Yet further, the aforementioned vertical partitions may include surface indicia to increase surface area and/or to increase turbulence at or near a vertical partition.

FIG. 6 also includes another upper plate 144' which is positioned below the lower plate 148. This particular upper plate 144' meets the lower plate 148 to form an outer seal at $y_{13}$, similar to the outer seal formed between the upper cover plate 132 and the upper plate 144 at $y_3$. Thus, in this example, each pair of plates forms an outer seal and an inner seal, the latter of which may be a gas inner seal about a gas flow aperture or a liquid inner seal about a liquid flow aperture. Further, an additional gas flow partition 168' is shown positioned below the second upper plate 144'. Of course, additional plates and/or partitions may follow.

Figure 7A:
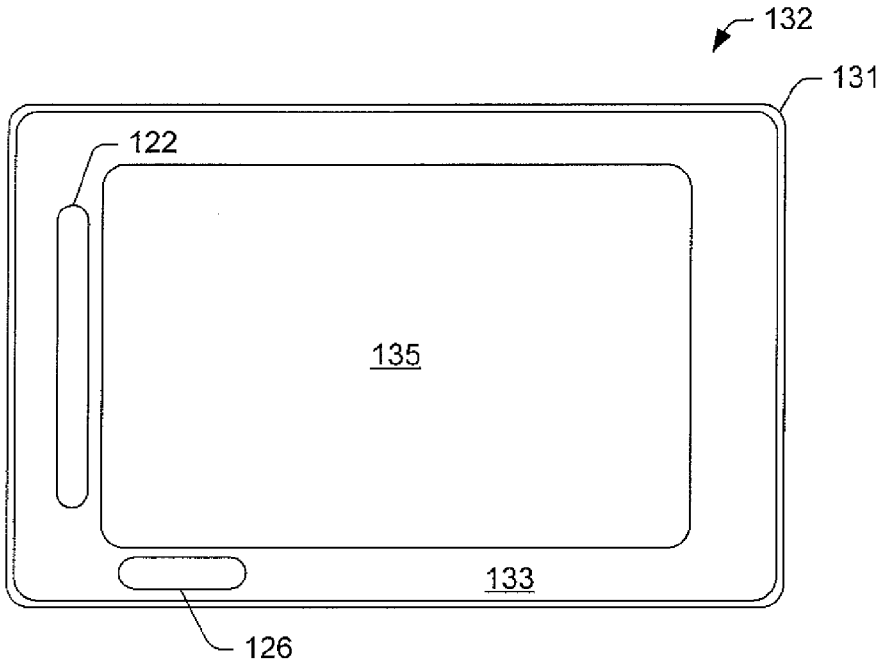
FIG. 7A is a top view of an exemplary upper cover plate.
Figure 7B:
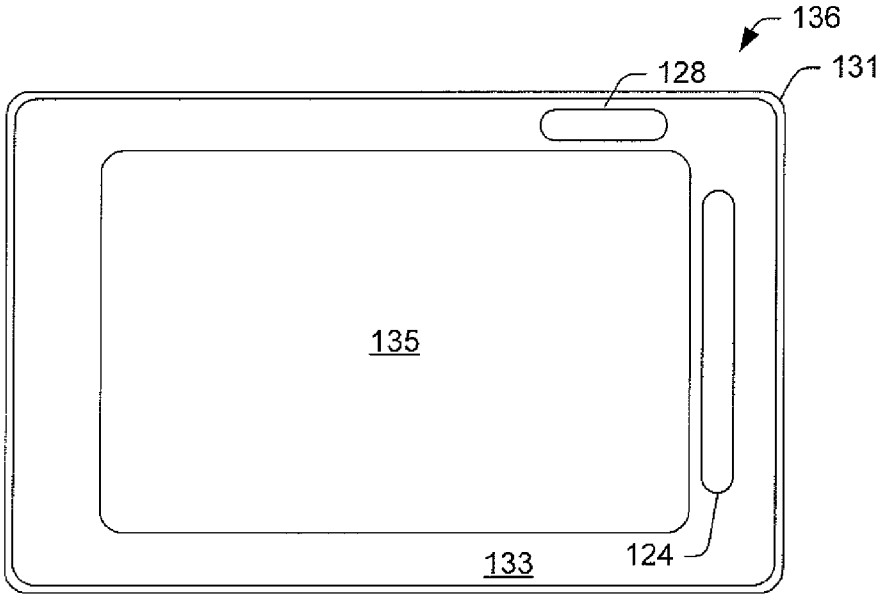
FIG. 7B is a top view of an exemplary lower cover plate.

FIG. 7A shows a top view of an exemplary upper cover plate 132. The upper cover plate 132 includes an outer edge or lip 131, a surface 133 having a gas inlet aperture 122 and a liquid inlet aperture 126, and a raised surface 135, which may help to define a flow space and/or accommodate a flow partition. The exemplary upper cover plate 132 may be used with an exemplary lower cover plate 136 shown in FIG. 7B. The exemplary lower cover plate 136 includes an outer edge and/or lip 131, a surface 133 having a gas outlet aperture 124 and a liquid outlet aperture 128, and a raised surface 135. The upper cover plate 132 of FIG. 7A and the lower cover plate 136 of FIG. 7B may be used in conjunction with suitable stack plates to form a heat exchange unit having fluid inlets on one side and fluid exits on an opposing side. Of course, a variety of other arrangements are possible as well.

Figure 8:
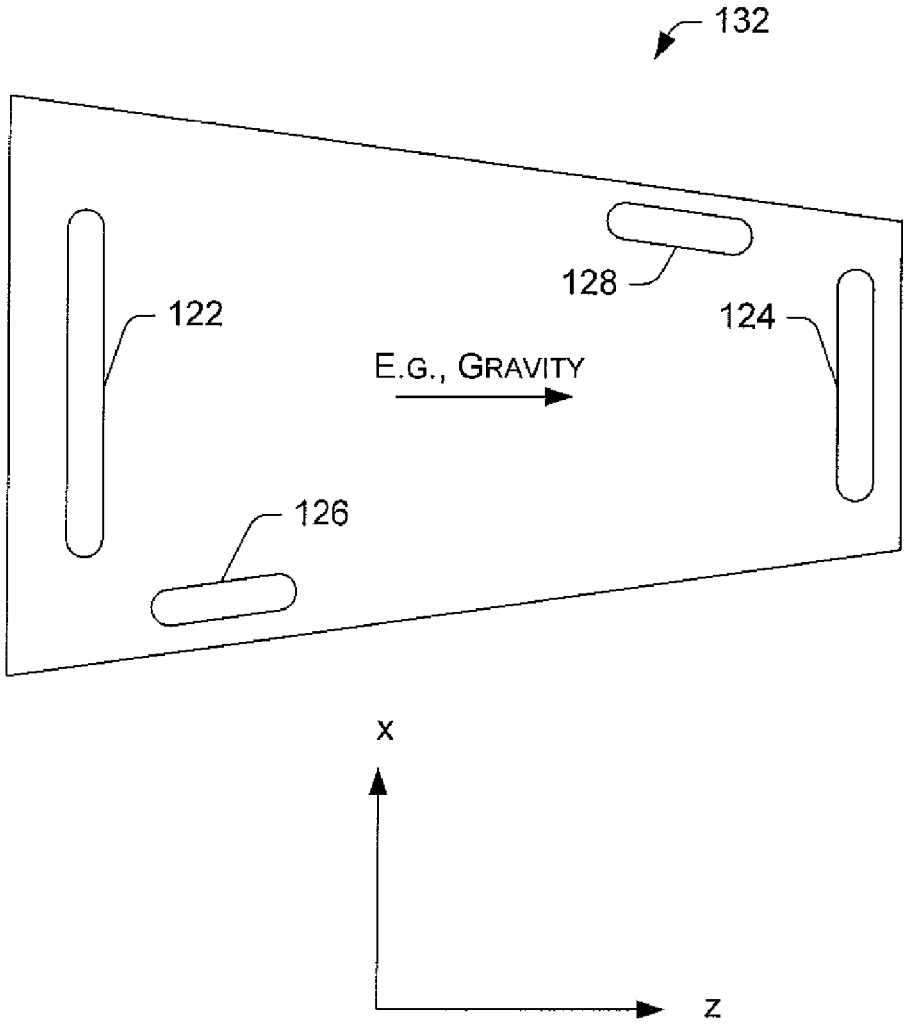
FIG. 8 is a top view of an exemplary cover plate having a variable width.

FIG. 8 shows an exemplary upper cover plate 132 having a gas inlet aperture 122, a gas outlet aperture 124, a liquid inlet aperture 126 and a liquid outlet aperture 128. Also shown are x and z axes. In this particular example, the primary direction of gas flow is in the z direction. The width of the upper cover plate 132 diminishes as a function of z. Hence, given stack plates having similar dimensions and equal gas flow spacing (e.g., along a y axis orthogonal to the xz-plane), the cross-sectional flow area for the gas decreases with respect to increasing distance along the z-axis. As mentioned above, such a decrease in cross-sectional flow area may help to maintain gas flow velocity. In this instance, the decrease in cross-sectional flow area occurs along the primary direction of gas flow and along the expected gas temperature gradient. Again, as the gas cools, its density will increase and cause a decrease in volumetric flow rate. Thus, a decrease in cross-sectional area will help to maintain or even increase gas velocity, which is typically related to heat transfer efficiency. In addition, or alternatively, the z-axis of any exemplary unit may coincide substantially with the acceleration of gravity. Thus, gravity may aid in maintaining or increasing gas velocity.

Figure 9A:
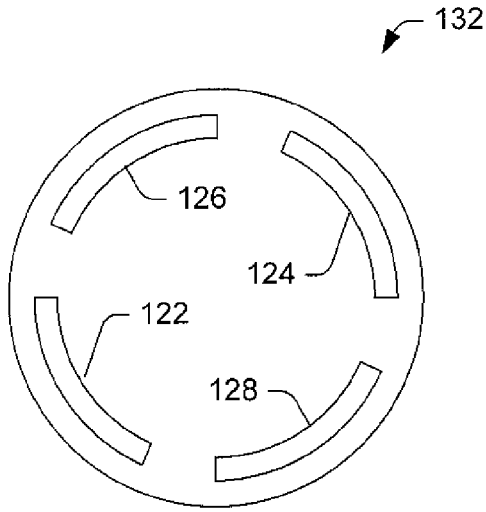
FIG. 9A is a top view of an exemplary cover plate having a substantially circular border.

FIG. 9A shows another exemplary cover plate 132. The cover plate 132 has a substantially circular border and one or more fluid inlets and/or outlets 122, 124, 126, 128. Stack plates having substantially circular borders are optionally used in conjunction with such a cover plate.

Figure 9B:
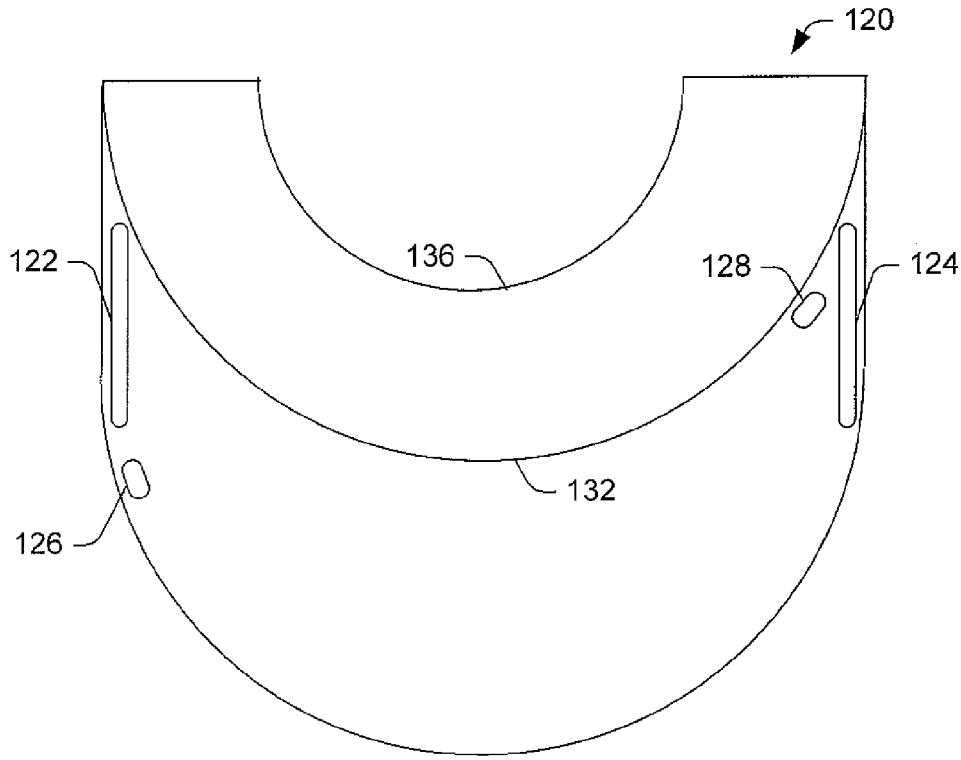
FIG. 9B is a top view of an exemplary stack and cover plates having a substantially semi-annular cross-section.

FIG. 9B shows an exemplary stack 120 having an upper cover plate 132 and a lower cover plate 136. The upper cover plate 132 has a plurality of fluid apertures 122, 124, 126, 128. The exemplary stack 120 and cover plates 132, 136 have a substantially semi-annular shape. The exemplary configurations shown in FIGS. 9A and 9B demonstrate that a heat exchange unit may have a shape that helps accommodate limitations commonly found in or near an engine compartment. For example, an exemplary EGR cooler unit may have a shape that minimizes interference with components that may have heat and/or other sensitivities.

Figure 10:
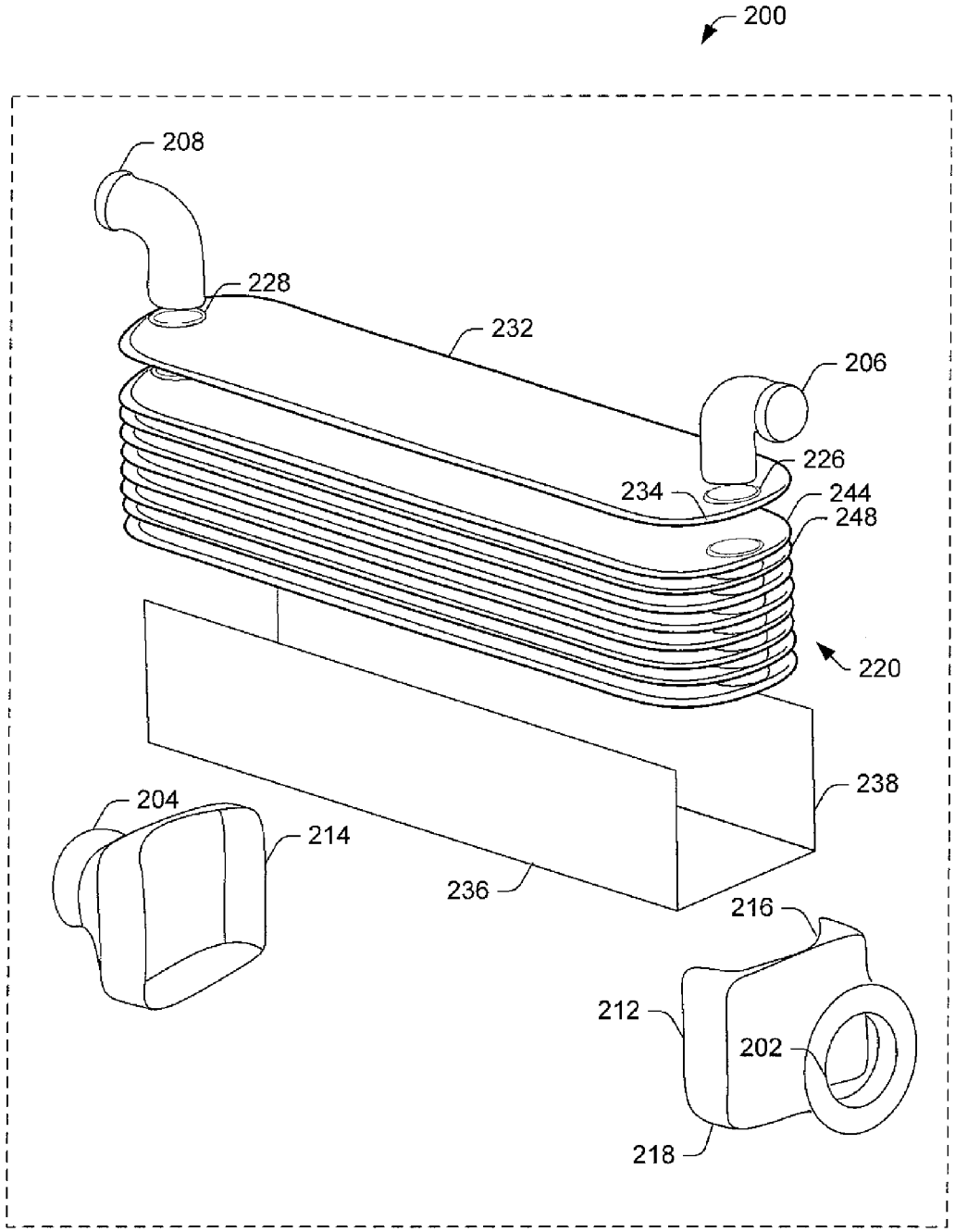
FIG. 10 is a perspective view of an exploded exemplary heat exchanger.

FIG. 10 shows a perspective view of an exemplary heat exchanger 200 that includes a core 220 and various housing components (e.g., 212, 214, 236). The housing components include an inlet header 212 and an outlet header 214 for flow of a shell side heat exchange fluid (e.g., liquid and/or gas) and a substantially U-shaped housing wall 236 that can surround at least part of the core 220 (e.g., three sides of the core 220). In general, the exemplary heat exchanger 200 has a shell side fluid space, defined at least in part by the housing components (e.g., 212, 214, 236) and a core side fluid space defined by the core 220.

As shown, the core 220 includes a stack of individual plates, such as, the plates 244, 248. A cover plate 232 may be considered a housing component and/or a plate of the core 220. For example, placement of the cover plate 232 over the individual plate 244 can form or define a fluid space between the cover plate 232 and the individual plate 244

(e.g., part of a core side fluid space). Such a fluid space can allow for flow of a fluid and exchange of heat energy between the fluid and another fluid (e.g., liquid or gas in a shell side space) wherein transfer of heat energy between the two fluids occurs at least in part via the cover plate 232 and/or the individual plate 244. In some instances, heat transfer may occur via an edge of a plate, for example, where the edge contacts another structure (e.g., the U-shaped housing wall 236, the inlet 212, the outlet 214, etc.).

In the exemplary heat exchanger 200, the housing components (e.g., 236, 212, 214) fit together cooperatively to house the core 220. The inlet header 212 has an inlet orifice 202, an upper edge 216 that conforms to part of the cover plate 232, and a lower edge 218 that conforms to an outer edge 238 of the U-shaped wall 236. Thus, once in place, the inlet header 212 can help form or define a shell side fluid space. In a similar manner, the outlet header 214 can help form or define a shell side fluid space. In the exemplary heat exchanger 200, the cover plate 232 also helps to define a shell side fluid space. Hence, in this example, the cover plate 232 serves as part of the core 220 to define a core side fluid space and as a housing component to define a shell side fluid space. Further, in this example, the cover plate 232 includes a lip 234 that, once in place, forms a seal with the U-shaped wall 236, the inlet header 212 and the outlet header 204. As shown, the lip 234 forms a seal with the U-shaped wall 236 along the lengthwise edges of the cover plate 232 and forms seals with the inlet header 212 and the outlet header 214 along the widthwise edges of the cover plate 232. In this example, the widthwise edges of the cover plate 232 are substantially arcuate and convex while the upper edge 216 of the inlet header 212 and the upper edge of the outlet header 214 are substantially arcuate and concave. Thus, in this example, the widthwise edges of the cover plate 232 are complementary to the upper edges of the headers 214, 216 (e.g., concave-convex, etc.).

In the exemplary heat exchanger 200, the complementary convex-concave edges of the cover plate 232 and headers 214, 216 allow for positioning of the inlet 226 closer to the header inlet 202 and/or for positioning of the outlet 228 closer to the header outlet 204. Further aspects of such positioning are described with reference to FIGS. 11 and 12.

Fluid may flow to and/or from the core 220 via one or more inlets or outlets. The cover plate 232 includes an inlet 226 for receiving an inlet conduit 206 and an outlet 228 for receiving an outlet conduit 208. Of course, the function of the cover plate inlet 226 and outlet 228 may be reversed. Thus, the exemplary heat exchanger 220 may operate in a substantially counter-current or co-current manner, depending on fluid flow into or out of the various inlets and outlets (e.g., 202, 204, 206, 208, 226, 228). Note that in a co-current operation, the inlet conduit 206 and the inlet header 212, as shown, may each receive a respective feeder conduit wherein the feeder conduits travel along parallel paths, for at least a portion of their lengths prior to meeting the inlet conduit 206 and the inlet header 202. Similarly, the outlet conduit 208 and the outlet header 214 may each receive an exit conduit wherein the exit conduits travel along parallel paths for at least a portion of their lengths after meeting the outlet conduit 208 and the outlet header 204. For counter-current operation, such parallel paths for conduits are also possible.

Figure 11:
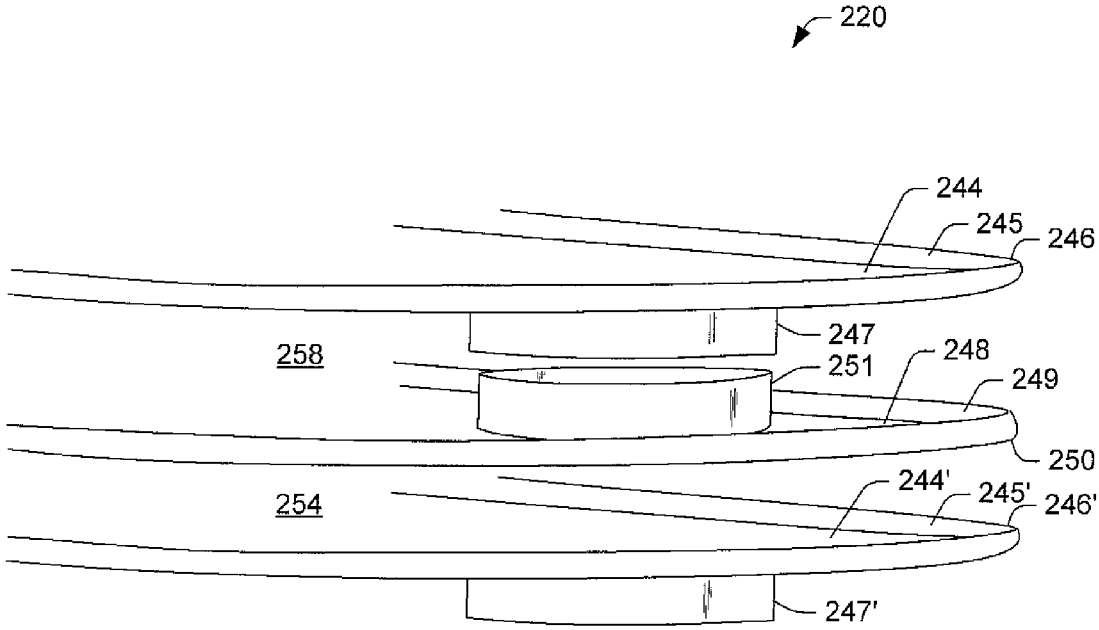
FIG. 11 is a perspective view of several plates.

FIG. 11 shows several exemplary plates 244, 248 of the exemplary core 220 of FIG. 10. An upper plate 244 includes a lip 245 having a substantially upwardly directed edge 246. The upwardly directed edge 246 optionally forms a seal with the lip 234 of the cover plate 232, where the upper plate 244 is the uppermost plate of the core 220. In such an instance, the uppermost plate and the cover plate 232 define a core side fluid space that may receive a fluid via the inlet 226. The upper plate 244 further includes a substantially downwardly directed and open shaft 247.

A lower plate 248 includes a lip 249 having a substantially downwardly directed edge 250. The lip 249 may deviate at first in an upward direction. However, as shown, the edge of the lip 250 deviates substantially downwardly, typically to a lowermost position of the lower plate 248. The lower plate 248 also includes a substantially upwardly directed and open shaft 251. In this example, upon proper positioning of the upper plate 244 and the lower plate 248, the open shaft 247 and the open shaft 251 form a sealed shaft. For example, the open shaft 247 may receive the open shaft 251 and/or vice versa. The two shafts 247, 251 may form a compression or press-fit seal and/or form a seal upon brazing or using other seal means (e.g., welding, chemical adhesion, chemical bonding, etc.). Once properly positioned, the upper plate 244 and the lower plate 248 define a fluid space 258, which is typically a shell side fluid space.

Another upper plate 244' may be positioned with respect to the lower plate 248. In this example, the lip 245' of the upper plate 244' forms a seal with the lip 250 of the lower plate 248. Such a seal may be a compression or press-fit seal and/or a seal formed upon brazing or use of other seal means (e.g., welding, chemical adhesion, chemical bonding, etc.). Once properly positioned, the upper plate 244' and the lower plate 248 define a fluid space 254, which is typically a core side fluid space.

The core 220 may also include a lower core plate, for example, a plate having features of the upper plate 244; however, without the substantially downwardly directed shaft 247. Such a plate may seal a core side fluid space from a shell side fluid space.

Figure 12:
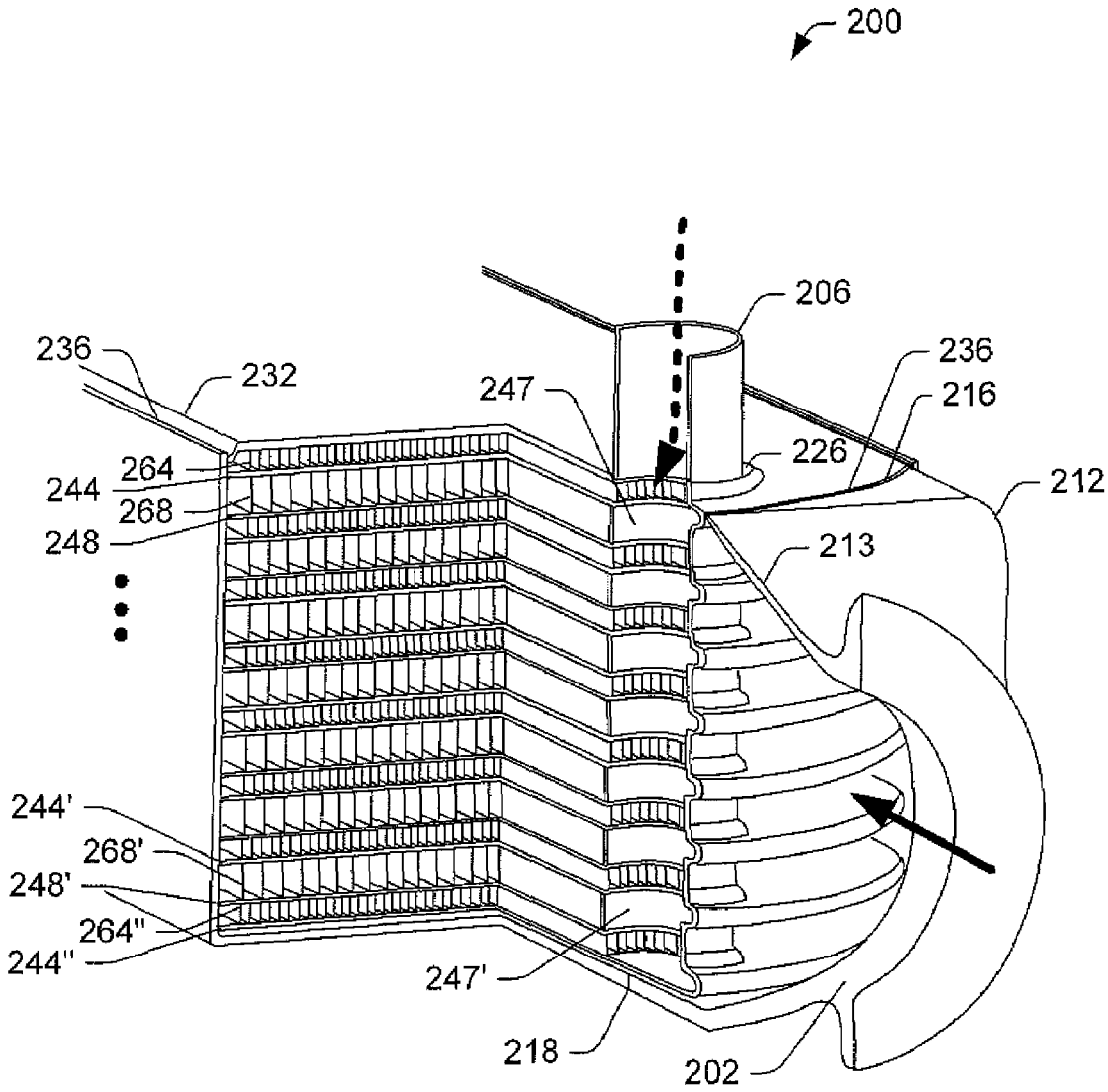
FIG. 12 is a perspective cut-away view of an exemplary heat exchanger.

FIG. 12 shows a perspective cutaway view of the exemplary heat exchanger 200 of FIG. 10. The cutaway view includes a substantially centered lengthwise cut and a widthwise cut just past the inlet 226. This view exposes a shaft region and plate space regions for core side fluid (e.g., dashed arrow) and plate space regions for a shell side fluid (e.g., solid arrow). Fluid may enter the core side via the inlet conduit 206, which is fitted to the inlet 226. Fluid may enter the shell side via the inlet 202 of the inlet header 212.

In this example, the lengthwise edges of the lip 236 of the cover plate 232 form seals along the lengthwise runs of the U-shaped wall 236, for example, compression or press-fit seals and/or seals formed upon brazing or use of other seal means (e.g., welding, chemical adhesion, chemical bonding, etc.). The foremost section of the lip 236 of the cover plate 232 forms a seal with the inlet header 212 at or near the upper edge 216. Similarly, an aftmost section of the lip 236 of the cover plate 232 forms a seal at or near the upper edge of the outlet header 214. The inlet header 212 also forms a seal with the U-shaped wall 236 at or near the edge of the inlet header 218. In this example, the inlet header has a cross-section that diverges (e.g., increases) in the direction of fluid flow, as illustrated by the diverging wall 213. The diverging cross-section helps to distribute shell side fluid more evenly in the shell (e.g., space defined by the housing).

The exemplary heat exchanger 200 includes a core having the cover plate 232, seven lower plates 248-248', seven upper plates 244-244' and one end plate 244". Various flow partitions are positioned in the eight core side spaces and the seven shell side spaces between the plates. In this example, the core side flow partitions 264 have a lesser height than the shell side flow partitions 268. Of course, other heights, height relationships and/or types of flow partitions are possible. While a shell side space may exist between the end plate 244" and the U-shaped wall; in general, the end plate 244" is in intimate contact with the U-shaped wall, or close enough thereto, to avoid channeling of shell side fluid in such a space.

The shaft region for flow of core side fluid has a plurality of shaft wall sections 247-247' that prevent fluid from entering the shell side of the heat exchanger 200. Note that the core side fluid spaces are accessible via the shaft via regions that bound the wall sections 247-247'.

As already mentioned, the convex-concave relationship between the cover plate 232 and the inlet header 212 may allow for a better distribution of shell side fluid. Further, shell side fluid distribution may be enhanced by positioning the core side fluid flow shaft in line with the inlet 202 of the inlet header 212. In the first instance, the convex widthwise edge of the cover plate and other plates creates a more streamlined core for the flow of shell side fluid. In the second instance, positioning of the core side fluid flow shaft in line with the inlet 202 of the inlet header 212 allows the shaft to obstruct incoming flow and hence prevent or reduce detrimental channeling of shell side fluid. In combination, the convex-concave relationship and the positioning of the shaft in line with the inlet 202 of the inlet header 212, allow shell side fluid to quickly encounter an obstruction and to flow more easily to the shell side space. For example, the convex-concave relationship may allow for a more forward positioning of the core side fluid shaft and for a reduction in eddy formation in shell side fluid, when compared to a heat exchanger core having a flat fore end. Further, the convex shape of the core may allow for increased strength of the shaft and/or the core when compared to a core having a flat fore end of substantially similar materials and construction.

Figure 13:
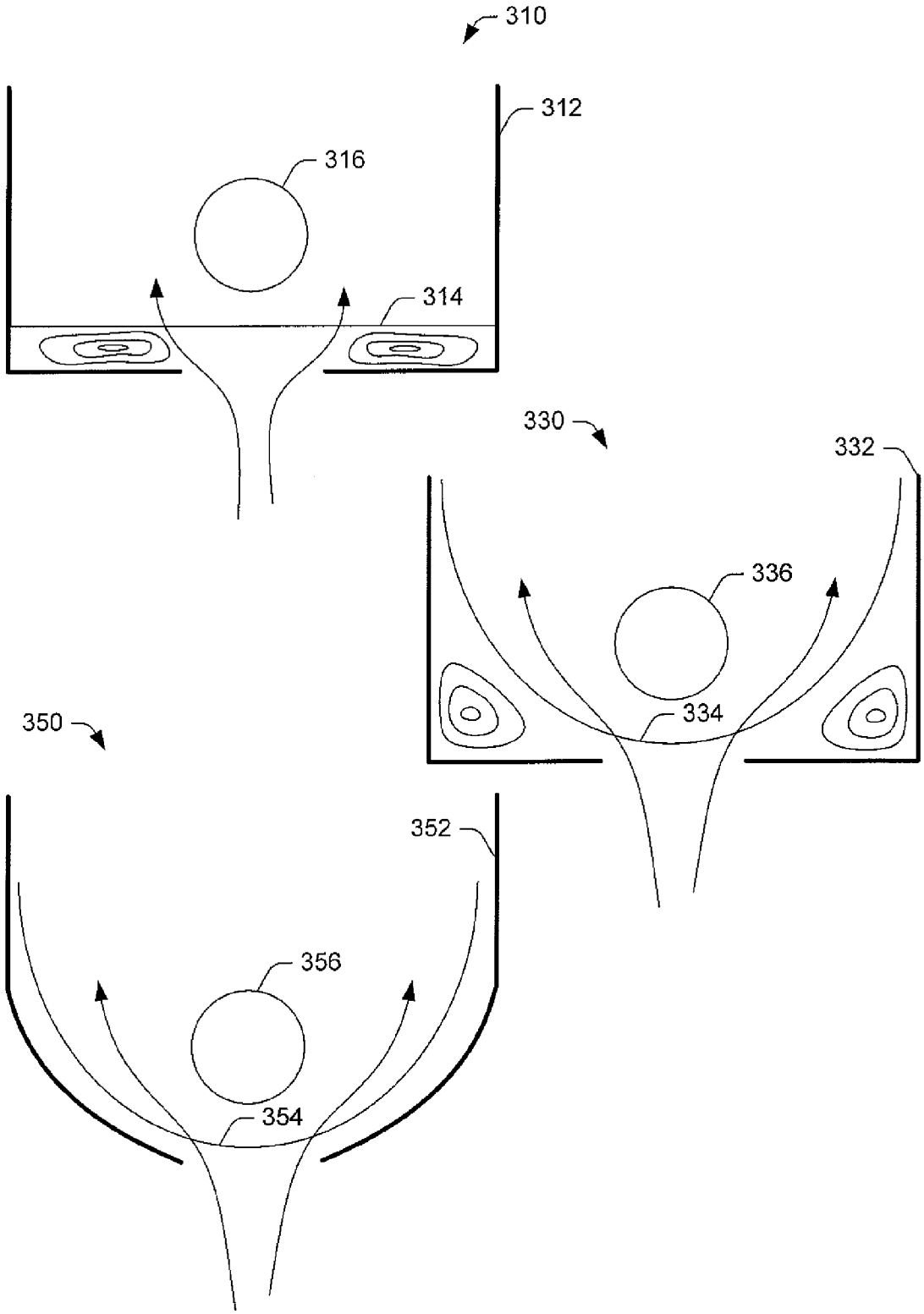
FIG. 13 is a series of fluid flow diagrams for various exemplary heat exchangers.

FIG. 13 shows various exemplary heat exchangers 310, 330, 350 and exemplary streamlines of shell side fluid flow. In the exemplary heat exchanger 310, fluid enters via an inlet in a housing 312. A header space exists in a region defined by the housing 312 and a flat fore end heat exchange core 314. Fluid entering this region forms one or more eddies around the inlet. The flow is diverted around a shaft 316 for core side fluid. In the exemplary heat exchanger 330, fluid enters via an inlet in a housing 332. A header space exists in a region defined by the housing 332 and a convex fore end heat exchange core 334. While fluid entering this region may form one or more eddies around the inlet, the flow is more streamlined as it is diverted around a shaft 336 for core side fluid.

In the exemplary heat exchanger 350, which corresponds approximately to the exemplary heat exchanger 200 of FIG. 12, fluid enters via an inlet in a housing 352. A relatively small header space exists in a region defined by the concave housing 352 and a convex fore end heat exchange core 354. While fluid entering this region may form one or more eddies around in this region, such eddies have less significance than eddies of examples 310, 330. The flow is diverted around a shaft 356 for core side fluid. In the example 350, the shape of the housing 352, the shape of the fore end of the core 354 and the shaft 356 all affect fluid flow. The shaft 356 helps to avoid channeling while the shape of the fore end of the core 354 and the shape of the housing 352 help to reduce header space and/or eddy formation. In this example, the shaft 356 lies at least partially in an area defined by the convex side of the core 354, which, in turn, is defined by various convex sides of plates of the core 354.

Figure 14:
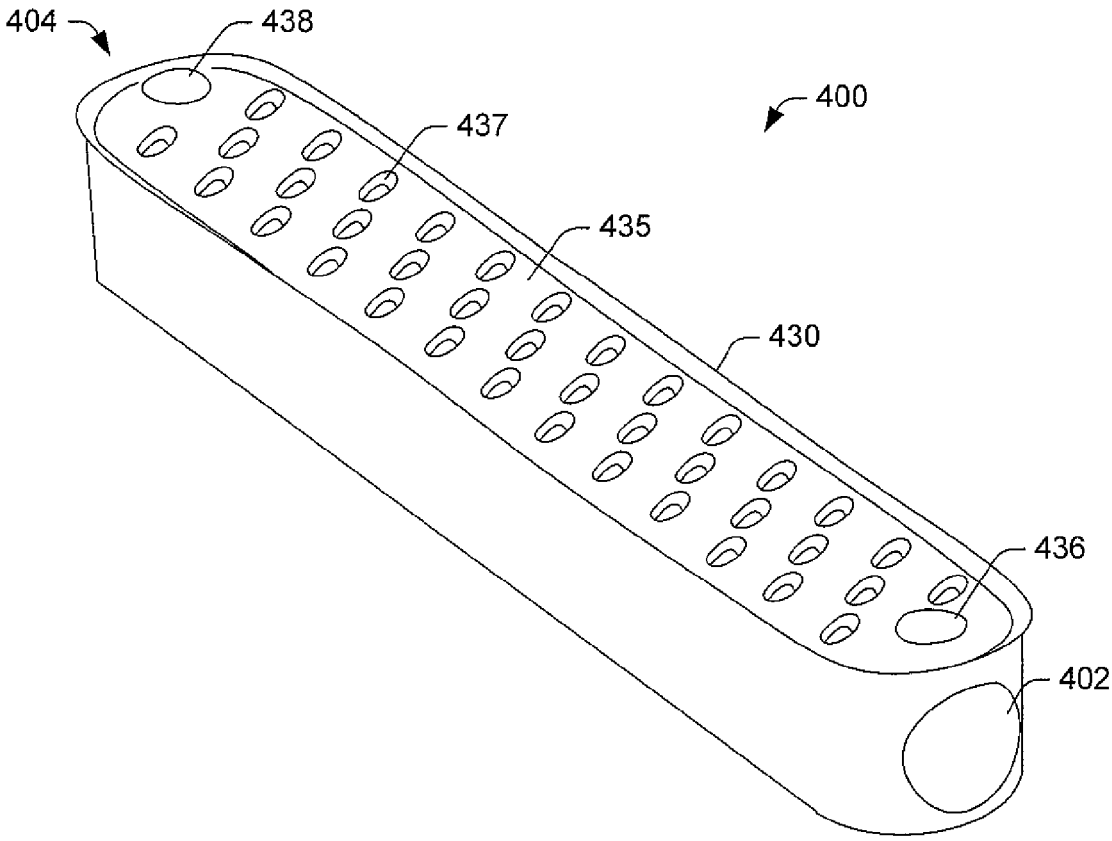
FIG. 14 is a perspective view of an exemplary heat exchanger housing.

FIG. 14 shows an exemplary housing 400 for a heat exchanger core. The exemplary housing 400 includes a basket portion 430 having an inlet opening 402 and an outlet opening 404 for shell side fluid and a cover 435 having one or more openings 436, 438 for core side fluid and optionally indicia 437 to direct fluid flow and/or heat transfer. The indicia 437 may increase surface area, which in turn may increase heat transfer. The indicia 437 may act to increase turbulence of fluid flow and increase surface area, both of which may increase heat transfer. The exemplary heat exchanger 200 of FIGS. 10-12 optionally includes the exemplary basket 430 instead of the U-shaped wall 236 and the inlet header 212 and/or outlet header 214. In another example, an exemplary heat exchanger includes a cover plate such as the cover plate 232 of the exemplary heat exchanger 200 and a core such as the core 220 together with a basket such as the basket 430.

Although some exemplary methods, devices and systems have been illustrated in the accompanying Drawings and described in the foregoing Detailed Description, it will be understood that the methods and systems are not limited to the exemplary embodiments disclosed, but are capable of numerous rearrangements, modifications and substitutions without departing from the spirit set forth and defined by the following claims.

What is claimed is:

1. A heat exchanger comprising:

a heat exchanger core having a core side fluid space and a cover plate; and a substantially U-shaped wall fitted at one end with an inlet header and, at an opposing end, with an outlet header, which, in combination with the cover plate, define a shell side fluid space;

wherein the cover plate forms two seals with two opposing sides of the substantially U-shaped wall, forms a seal with the inlet header and forms a seal with the outlet header and wherein the cover plate defines a core side fluid space with a plate of the heat exchanger core.

2. The heat exchanger of claim 1 wherein the cover plate comprises a lip.

3. The heat exchanger of claim 2 wherein the lip of the cover plate forms the seals with the two opposing sides of the substantially U-shaped wall, the inlet header and the outlet header.

4. The heat exchanger of claim 1 wherein the seals comprise at least one seal mechanism selected from a group consisting of compression or press-fit seals, brazed seals, welded seals and chemical bonding seals.

5. The heat exchanger of claim 1 wherein the inlet header comprises an arcuate upper edge, wherein the outlet header comprises an arcuate upper edge and wherein the cover plate comprises a widthwise arcuate edge that is complementary to the upper edge of the inlet header and a widthwise arcuate edge that is complementary to the upper edge of the outlet header.

6. The heat exchanger of claim 5 wherein the cover plate forms a seal with the inlet header at its complementary widthwise arcuate edge and wherein the cover plate forms a seal with the outlet header at its complementary widthwise arcuate edge.

7. The heat exchanger of claim 1 wherein the cover plate comprises a fluid inlet for the core side fluid space and a fluid outlet for the core side fluid space.

8. The heat exchanger of claim 1 wherein the inlet header covers inlet header side edges of the U-shaped wall.

9. The heat exchanger of claim 1 wherein the inlet header covers an inlet header side edge of the cover plate.

10. The heat exchanger of claim 1 wherein the outlet header covers outlet header side edges of the U-shaped wall.

11. The heat exchanger of claim 1 wherein the outlet header covers an outlet header side edge of the cover plate.

12. The heat exchanger of claim 1 wherein the inlet header comprises an arcuate shape complementary to an arcuate shape of the heat exchanger core.

13. The heat exchanger of claim 1 wherein the outlet header comprises an arcuate shape complementary to an arcuate shape of the heat exchanger core.

14. The heat exchanger of claim 1 wherein the heat exchanger core comprises a plurality of plates.

15. The heat exchanger of claim 1 wherein the heat exchanger core comprises core side flow partitions.

16. The heat exchanger of claim 1 wherein the shell side space comprises shell side flow partitions.

17. The heat exchanger of claim 16 wherein the heat exchanger core comprises core side flow partitions having a less height than the shell side flow partitions.

18. The heat exchanger of claim 1 further comprising parallel heat exchanger core side flow partitions and parallel shell side flow partitions.

19. The heat exchanger of claim 1 wherein the heat exchanger comprises a heat exchanger for use in exhaust gas recirculation to cool exhaust gas.

20. A heat exchanger comprising:

a heat exchanger core having a core side fluid space and a cover plate wherein the cover plate defines part of the core side fluid space; and a basket comprising an inlet at one end and an outlet at an opposing end wherein the cover plate forms a seal with the basket to form a shell fluid side space.

21. The heat exchanger of claim 20 wherein the cover plate comprises indicia to direct fluid flow in the core side fluid space and thereby increase heat transfer.

22. The heat exchanger of claim 20 wherein the heat exchanger comprises a heat exchanger for use in exhaust gas recirculation to cool exhaust gas.

* * * * *